US005472741A

United States Patent [19]

Sackmann et al.

[11] Patent Number: 5,472,741

[45] Date of Patent: Dec. 5, 1995

[54] SOFTENING AND WATERPROOFING RETANNING AGENTS

[75] Inventors: Günter Sackmann, Leverkusen; Bruno Bömer, Bergisch Gladbach; Joachim Kochta, Bonn; Henricus Slaats, Leverkusen, all of Germany

[73] Assignee: Bayer Aktiengesellschaft, Leverkusen, Germany

[21] Appl. No.: 319,191

[22] Filed: Oct. 6, 1994

[30] Foreign Application Priority Data

Oct. 13, 1993 [DE] Germany ..... 43 34 796.7

[51] Int. Cl.[6] ..... B05D 3/02

[52] U.S. Cl. ..... 427/389; 8/94.33; 525/327.7

[58] Field of Search ..... 427/389; 8/94, 8/33; 525/327.7

[56] References Cited

U.S. PATENT DOCUMENTS

| | | | |
|---|---|---|---|
| 4,000,958 | 1/1977 | Hirooka et al. | 423/389 |
| 4,151,336 | 4/1979 | Sackmann et al. . | |
| 4,190,687 | 2/1980 | Sugiura et al. | 427/389 |
| 4,250,289 | 2/1981 | Denzinger et al. | 526/201 |
| 4,527,992 | 7/1985 | Friese et al. . | |
| 5,124,181 | 6/1992 | Schaffer et al. . | |

FOREIGN PATENT DOCUMENTS

| | | |
|---|---|---|
| 0372746 | 6/1990 | European Pat. Off. . |
| 1495598 | 12/1977 | United Kingdom . |

*Primary Examiner*—Bernard Lipman
*Attorney, Agent, or Firm*—Sprung Horn Kramer & Woods

[57] ABSTRACT

Copolymers containing incorporated radicals of long-chain alcohols and neutralized carboxyl groups are suitable as retanning agents for leather. They result in an excellent combination of water repellency, softness and grain tightness.

3 Claims, No Drawings

SOFTENING AND WATERPROOFING RETANNING AGENTS

The invention relates to improved retanning agents for producing soft hydrophobic leathers.

While tanning leads to an increase in the shrinking temperature of the leather, this temperature is hardly affected by retanning. "Retanning" is understood to mean an after-treatment of pre-tanned (in general chrome-tanned) leather designed for optimizing colour, levelness, softness, fullness and hydrophobicity and for fixing tanning agents.

Today's most important retanning agents include, apart from the group of the so-called syntans, carboxyl-containing polymers in salt form (EP-A-118,023 and 372,746, German Offenlegungsschrift 3,931,039). However, polyurethanes which, if desired, may contain polyethylene oxide groups, ionic groups or methylol groups have also already been used for retanning (German Offenlegungsschrift 2,504,081).

The previously known retanning agents do not fulfil the expectations of them because either they are insufficiently waterproofing or adversely affect the handle, dyeability, grain tightness or subsequent finishing of the leathers. The multiplicity of desirable properties requires a compromise. What is desired are retanning agents which give the leather optimum water repellency (i.e. make the leather as impermeable to water as possible while maintaining its water vapour permeability), but do not adversely affect the handle, dyeability, grain tightness and application of the finish.

Surprisingly, it has now been found that the use of specific copolymers containing incorporated radicals of long-chain alcohols and neutralized (and, if desired, free) carboxyl groups gives a favourable combination of water repellency, softness and grain tightness.

Accordingly, the invention relates to the use of reaction products obtained from (A) a terpolymer having molecular weights $\overline{M}_n$, determined as number average, of 5000 to 60 000 made of
  a) maleic anhydride,
  b) 80 to 120 mol %, relative to component a) , of diisobutylene, and
  c) 1 to 12 mol % relative to component a), of at least one monomer of the formula

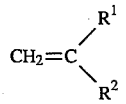

in which
$R^1$ denotes hydrogen or methyl,
$R^2$ denotes hydrogen, methyl, ethyl, —$OR^3$, $$-CH_2-O-\underset{\underset{O}{\|}}{C}CH_3,$$

$$-O\underset{\underset{O}{\|}}{C}CH_3,$$

unsubstituted or $C_1$–$C_4$-alkyl substituted phenyl or hydroxymethyl, and
$R^3$ denotes $C_1$–$C_4$-alkyl, (B) an aliphatic and/or cycloaliphatic monohydric $C_6$–$C_{24}$-alcohol, and (C) a base, 20 to 80%, preferably 30 to 75%, of the carboxyl groups corresponding to the anhydride groups of the terpolymer being esterified with alcohol (B) and at least 20% of the remaining carboxyl groups being neutralized with base (C), as retanning agent for leather.

Maleic anhydride (monomer a) and diisobutylene (monomer b) usually polymerize alternately. The presence of a third comonomer c) also leads to alternating copolymers, the molar ratio of a: (b+c) in the copolymer being about 1:1.

Examples of preferred monomers c) include styrene, α-methylstyrene, p-methylstyrene, vinyl acetate, allyl acetate, isobutyl vinyl ether, allyl alcohol and methallyl alcohol.

Terpolymers made up of a), b) and c) are known; see, for example, German Offenlegungsschrift 2,701,760. They can be prepared via polymerization initiated by free radicals. The polymerization takes place under polymerization conditions in an inert organic solvent, in particular in an aromatic solvent, such as toluene or xylene.

Examples of suitable free radical formers include diacyl peroxides, such as diacetyl peroxide, dibenzoyl peroxide, di-p-chlorobenzoyl peroxide, peroxy esters, such as tert.-butyl peroxyacetate, tert.-butyl peroxybenzoate, dicyclohexyl peroxydicarbonate, alkyl peroxide, such as bis(tert.-butylperoxybutane), dicumyl peroxide, tert.-butyl cumyl peroxide, hydroperoxides, such as cumene hydroperoxide, tert.-butyl hydroperoxide, ketone peroxides, such as cyclohexanone hydroperoxide, methyl ethyl ketone hydroperoxide, acetylacetone peroxide or azobisisobutyronitrile. The usual amounts are 0.01 to 5% by weight, preferably 0.1 to 3% by weight, relative to the sum of the monomers a), b) and c) to be polymerized.

The reaction of terpolymers A with alcohols B can either be carried out directly in the solution of terpolymers A or, after isolation of the solid terpolymers A, in substance, solution or suspension. The reaction can take place at temperatures of 60° to 180° C., preferably 80° to 140° C.

Preference is given to primary and secondary alcohols B. Examples of suitable representatives include n-hexanol, cyclohexanol, n-octanol, 2-ethylhexanol, n-dodecanol, n-tetradecanol, n-hexadecanol, stearyl alcohol, eicosanol and behenyl alcohol and mixtures thereof.

The reaction can take place in the absence or presence of an acid catalyst. Suitable catalysts of this type are, for example, mineral acids, such as sulphuric acid or anhydrous hydrogen chloride, aliphatic and aromatic sulphonic acids, such as methanesulphonic acids and p-toluenesulphonic acid, fluorinated aliphatic carboxylic acids, such as perfluorobutanoic or -octanoic acid, and acid ion exchangers. If esterification takes places in the presence of an acid catalyst, it is advantageous, for the purpose of removing the water of reaction, to carry out the reaction in a water-immiscible organic solvent, such as, for example, toluene or xylene, and to separate off the water of reaction formed azeotropically. Esterification in the absence of a catalyst converts the anhydride groups mainly to the monoester, while acid-catalysed esterification leads to mixtures of mono- and diesters of the dicarboxylic acid radicals.

In order to convert the esterification products obtained into a water-soluble or -dispersible form, base C is added, preferably as an aqueous solution. Examples of suitable bases C include alkali metal hydroxides and alkali metal alcoholates and ammonia and primary, secondary and tertiary aliphatic amines having up to 6 C atoms per molecule (which may carry up to 1 hydroxyl group per alkyl radical), in particular sodium hydroxide and potassium hydroxide and ammonia, ethylamine, propylamine, n-butylamine, diethanolamine, dimethylamine and triethylamine. Base C can be added to the polymer melt or polymer solution or polymer dispersion. The amount of base C is such that at least 20% of the carboxyl groups remaining after the esterification reaction are converted. It is possible to convert all remaining carboxyl groups; however, it can also be advantageous to neutralize only 20 to 80% of the remaining carboxyl groups (in this context, anhydride groups which have not reacted in the esterification reaction are formally to be counted as 2 carboxyl groups). The reaction of residual anhydride groups with alkali metal hydroxide solution gives the corresponding carboxylates, while ammonia, primary and secondary amines produce the monoamide/monoammonium salts and tertiary aliphatic amines usually the diammonium salts (in each case relative to 1 original anhydride group). The reaction with base C gives aqueous solutions or dispersions which may still contain organic solvents. They can be directly used as such or after removal of the solvent for the retanning of leather. They are suitable in particular for all types of chrome leather (cow, goat, pig, and the like).

The resulting aqueous solutions or dispersions are preferably used on neutralized wet blue material, i.e. on chrome leather which has been given a pH of 4 to 7, preferably 5.5 to 6.5, by means of customary neutralizing agents (for example sodium bicarbonate, sodium formate, and the like) or neutralization tanning agents. The amounts used are in general 0.5 to 8, preferably 1 to 4, in particular 1 to 2, % by weight, calculated as dry matter and based on the wet blue shaved weight.

As retanning progresses, the neutralized wet blue material can, if desired, be treated with commercially available retanning agents (exchange tanning, tawing, resin tanning and polymer tanning agents), vegetable tanning agents and fat-liquoring agents. If dyed leathers are to be produced, dyeing is carried out with dyestuffs. Moreover, it is also possible to use the solutions or dispersions for retanning before dyeing and fat-liquoring on leathers which have only been tanned by vegetable tanning agents.

The aqueous solutions or dispersions obtained can also be used in other stages of retanning, for example after the treatment with exchange tanning, tawing or vegetable tanning agents.

The leathers retanned according to the invention are distinguished by a very soft and full handle and a tight and smooth grain and exhibit distinct pigmentation. Owing to their high lightfastness and their good thermal yellowing resistance, they are highly suitable for producing light-coloured leathers. In addition, the leathers retanned by the dispersions according to the invention exhibit water-repellent properties.

The examples which follow illustrate the preparation of the aqueous solutions and dispersions to be used according to the invention and their use in various recipes for the retanning of various leather types.

The percentages given in the examples which follow are in each case by weight unless stated otherwise. Mixing and dilution ratios are also by weight unless stated otherwise.

EXAMPLES

A. Preparation of the retanning agents

1. Retanning agent I

A 1 l three-neck flask equipped with stirrer and reflux condenser is charged with 105 g of a maleic anhydride/2,4,4-trimethyl-1-pentene/styrene terpolymer having a molecular weight $\overline{M}_n$ of 15,000, and 378 g of toluene and 57.0 g of a fatty alcohol mixture consisting of aliphatic monoalcohols having linear alkyl chains of a chain length between 12 and 18 C atoms are added. The reaction mixture is heated to 80° C. with stirring while passing $N_2$ over it and maintained at this temperature for 24 hours. A solution of 30 g of NaOH in 1200 ml of water is added to the resulting clear solution with further stirring to give a relatively viscous emulsion. The solvent is distilled off from this emulsion at 50° to 60° C. under reduced pressure to leave a finely divided emulsion having a solids content of 12.7% by weight.

2. Retanning Agent II

Retanning agent II is prepared by the procedure described in Example I, except that 127.4 g of a $C_{14}$–$C_{22}$-alkanol mixture (composition: 2% $C_{14}$, 51±4% $C_{16}$, 28±4% $C_{18}$, 14±4% $C_{20}$, 3% $C_{22}$) are used as the fatty alcohol for esterifying the maleic anhydride/2,4,4-trimethyl-1-pentene/styrene terpolymer ($\overline{M}_n$=15,000). To prepare the aqueous emulsion, a solution of 20 g of NaOH in 2300 g of water is added to the solution of the esterified polymer. Removal of toluene by distillation under vacuum gives a finely divided emulsion of retanning agent II having a solids content of 9.5% by weight.

3. Retanning agent III

A 2 l three-neck flask is charged with the following reaction mixture:

178 g of toluene 170 g of diisobutylene (technical grade mixture comprising 75–80% by weight of 2,4,4-trimethyl-1-pentene and 20–25% by weight of 2,4,4-trimethyl-2-pentene)

102 g of maleic anhydride with stirring while passing $N_2$ over it.

The reaction mixture is heated to 75° C., and the following solution is pumped in via a metering pump over a period of 4 hours:

4 g of azobisisobutylnitrile 50 g of toluene

During the metered addition of the initiator solution, the reaction temperature is continuously raised from 75° to 95° C. 30 minutes before metered addition is complete, 6 g of styrene are added to the polymerization solution all at once. The mixture is then additionally stirred at 95° C. for 6 hours ($\overline{M}_n$=20,000).

After cooling the solution to 80° C., 178 g of a $C_{12}$–$C_{18}$-fatty alcohol mixture and 400 g of toluene are added, and esterification is carried out at 80° C. for 24 hours. A solution of 51.9 g of NaOH in 1500 ml of water is then added to this polymer solution, and the toluene is distilled off from the resulting emulsion at 50°–60° C. under reduced pressure to leave an aqueous emulsion of the retanning agent III having a solids content of 15.7% by weight.

4. Retanning agent IV

Retanning agent IV is prepared similarly to retanning agent III, except that the solution of the terpolymer is made to react with the following mixture:

237 g of a $C_{12}$–$C_{18}$-fatty alcohol mixture 650 g of toluene.

After 24 hours of esterification at 80° C., a solution of 41.6 g of NaOH in 2000 g of water is added to this solution with stirring to give an emulsion. Removal of the toluene by distillation at 50°–60° C. under reduced pressure gives a finely divided emulsion having a solids content of 20.7% by weight.

B. Application

Example 1: Production of white furniture leathers

To produce furniture leathers, 50 kg of wet blues chrome-tanned and shaved to 1.2 to 1.4 mm in the usual manner are first fulled in the tanning drum in 250 to 350% of water (based on the shaved weight, as are all the percentages which follow) at 40° C. with the addition of 0.3 to 0.5% formic acid (85% strength, diluted 1:10 with water) and 2.0% of a lightfast commercially available tawing agent for 30 minutes. The pH of the liquor is about 3.8. The liquor is discharged, and the leathers are then washed in 300% of water at 40° C. for 10 minutes.

After discharge of the liquor, the leathers are rechromed in 150% of water at 40° C. with 1% of a commercially available chrome-tanning agent and 3% of a commercially available, self-basifying chrome/syntan mixed tanning agent over a period of 45 minutes, fat-liquored with 7% of commercially available synthetic fat-liquoring agent over a period of 30 minutes, and 1.5% of a commercially available, lightfast neutralization tanning agent, 4.0% of a commercially available tawing agent and 3.0% of a commercially available resin tanning agent are then added.

After a running time of 15 minutes, 1%, based on dry matter, of the dispersion IV according to the invention is added as a 20.7% strength formulation, and processing is continued for another 45 minutes.

The pH of the liquor is about 5.2.

1.5% of sodium formate and 0.5% of sodium bicarbonate are added (pH of the liquor about 6.1), and the liquor is discharged after 40 minutes. The leathers are then washed with 300% of water at 40° C. for 10 minutes, fat-liquored and finished by the customary procedure (set out, wet-toggled and dried, conditioned, staked, dry-drummed and toggled).

The resulting leathers exhibit good fullness and softness and are distinguished by excellent grain smoothness. The lightfastness rating is 5 to 6 (Xeno-Test) and the heat yellowing rating (24 hours, 120° C.) is 3 to 4 (grey scale).

Example 2: Production of coloured automotive upholstery leathers

To produce automotive upholstery leathers, 50 kg of wet blues chrome-tanned and shaved to 1.1 to 1.3 mm in the usual manner in a tanning drum are, as described in Example 1, washed, treated with formic acid, pre-tanned with a tawing agent, washed again, chrome-retanned, fat-liquored and retanned with 1.5% (based on the shaved weight, as are all the percentages which follow) of a commercially available neutralization tanning agent, 4.0% of a commercially available exchange tanning agent and 3% of a commercially available resin tanning agent.

After a running time of 15 minutes, 1.5%, relative to dry matter, of the dispersion III according to the invention are added as a 15.7% formulation, and processing is continued for another 45 minutes.

The pH of the liquor is about 5.0. The pH is raised to about 6.0 by addition of 1.5% of sodium formate and 0.4% of sodium bicarbonate, and the liquor is discharged after 40 minutes.

After 10 minutes of washing in 300% of water at 40° C. and discharge of the liquor, the leathers are pigmented in 30% of water at 25° C. with 5.0% of a mixture of commercially available leather dyestuffs over a period of 30 minutes with the addition of 1.0% of a commercially available dyeing assistant.

After the addition of 10% of a synthetic fat-liquoring agent, the leathers are fat-liquored for 30 minutes. 150% of water at 70° C. is then added, and the dyestuff is fixed after 5 minutes by addition of 2.5% of formic acid (85% strength, diluted 1:10 with water, addition in 2 portions). The pH of the liquor is about 4.0.

After discharge of the liquor, the leathers are washed with 300% of water at 40° C., rinsed at 25° C. for 10 minutes, and then finished by the customary procedure.

The resulting leathers exhibit good fullness and softness and are distinguished by highly smooth grains and a fine drum pattern.

Example 3: Production of shoe upper leather

To produce shoe upper leather, 35 kg of wet blues chrome-tanned and shaved to 1.6 to 1.7 mm in the usual manner are first washed in a tanning drum in 200% of water (based on the shaved weight, as are all the percentages which follow) at 50° C. and 0.4% of formic acid (85% strength, diluted 1:10 with water) for 15 minutes. After discharge of the liquor, neutralization is carried out in 100% of water at 40° C. by means of 2% of a commercially available neutralization tanning agent and 0.8% of sodium bicarbonate. After 45 minutes of neutralization, the pH of the liquor is about 5.2.

1.5%, relative to dry matter, of the dispersion I according to the invention (see Preparation Example 1) are added as a 12.7% formulation, and processing is continued for 30 minutes. The pH of the liquor is about 5.0.

3% of a commercially available exchange tanning agent, 4% of quebracho and 1.5% of dyestuff are added, and, after a running time of 90 minutes, the liquor is acidified to a pH of about 4.2 by means of 0.5% formic acid (85% strength, diluted 1:10 with water).

After discharge of the liquor, the leathers are fat-liquored in 100% of water at 50° C., the liquor is again acidified to a pH of 3.9, and the liquor is again discharged. After 10 minutes of rinsing in warm water at 25° C., the leathers are set out, vacuum- and hanger-dried, conditioned, staked and again vacuum-dried (½ minute at 70° C.) by the customary procedure. The resulting leathers are distinguished by uniform dyeability while having a full soft handle in combination with a tight grain.

Example 4: Production of split leather

To produce split leather, 25 kg of chrome split leather produced in the usual manner (thickness about 1.3 mm) are washed in 200% of water (based on the split weight, as are all the data which follow) at 50° C. for 10 minutes.

After discharge of the liquor, neutralization is carried out in 100% of water at 40° C. by means of 2% of a commercially available neutralization tanning agent and 1.5% of sodium bicarbonate over a period of 90 minutes until a pH of about 5.8 is reached.

After 15 minutes of pre-fat-liquoring with 2% of synthetic fat-liquoring agent, 1.2%, relative to dry matter, of the dispersion II according to the invention from Preparation Example 2 are added as a 9.5% formulation, and the split leathers are fulled for 45 minutes.

6.0% of a commercially available tawing agent are then added, and after 45 minutes the pH of about 5.5 is lowered to about 4.5 over a period of 15 minutes by addition of 0.5% formic acid (85% strength, diluted 1:10 with water).

After discharge of the liquor, the leathers are washed in 200% of water at 60° C. for 10 minutes and fat-liquored in 100% of water at 60° C. with 7.0% of a commercially available mixture of fats.

The pH of the liquor is about 4.5.

In order to achieve better fullness and softness, it is possible to add, if desired, another 0.5%, relative to dry matter, of the abovementioned dispersion during fat-liquoring.

Finally, the leathers are acidified to a pH of about 4.0 by addition of 0.5% of formic acid (85% strength, diluted 1:10 with water). The leathers are rinsed (water at 20° C., 5 minutes), set out, vacuum- and hanger-dried, conditioned, staked, aerated, restaked and again vacuum-dried (½ minute, 70° C.) by the customary procedure.

The resulting splits have a very high degree of whiteness and are distinguished by a soft full handle, the velour side exhibiting a soft, uniform short buff.

Example 5: Production of garment nappa

To produce garment nappa, 20 kg of New Zealand wet blue are washed in 200% of water (based on the shaved weight, as are all the data which follow) at 40° C. and 0.5% of a commercially available emulsifier for 20 minutes. After discharge of the liquor, the leathers are re-chromed in 100% of water at 40° C. with a commercially available self-basifying chrome/syntan retanning agent over a period of 15 minutes, 1% of a commercially available synthetic fat-liquoring agent is added, and after a running time of 45 minutes, the leathers are neutralized to a pH of 5.5 with 3% of a commercially available neutralization tanning agent and 0.3% of sodium bicarbonate over a period of 45 minutes.

After addition of 300% of water at 40° C., the liquor is discharged after 10 minutes.

This is followed by 45 minutes of fulling in 100% of water at 40° C. to which 1.5%, relative to dry matter, of the dispersion III according to the invention from Preparation Example 3 has been added as a 15.7% formulation.

3% of a commercially available exchange tanning agent are added, and 3% of dyestuff are added after a running time of 20 minutes. After 40 minutes, the liquor is acidified to a pH of about 3.8 with 2% of formic acid (85% strength, diluted 1:10 with water) over a period of 30 minutes.

After discharge of the liquor, the leathers are crossdyed in 200% of water at 50° C. with 1.5% of dyestuff, and the liquor is acidified to a pH of 3.5 with 1.5% of formic acid (85% strength, diluted 1:10 with water) over a period of another 20 minutes.

The leathers are rinsed with cold water and finished by the customary procedure (dried, dry-drummed, staked, and the like).

The leathers have a soft full handle and are distinguished by a fine smooth grain and a uniform, brilliant dye.

Example 6: Production of vegetable leathers

To produce vegetable upper leather, leathers tanned in the usual manner by vegetable tanning agents are washed in 300% of water (based on the shaved weight, as are all the data which follow) at 30° C. for 10 minutes and, after discharge of the liquor, bleached in 100% of water at 30° C. with 1% of a commercially available bleaching tanning agent over a period of 20 minutes (pH of the liquor about 3.3) and washed with 300% of water at 40° C.

After discharge of the liquor, the leathers are treated in 100% of water at 40° C. with 1.5%, relative to dry matter, of the dispersion IV according to the invention from Preparation Example 4 as a 20.7% formulation for 20 minutes. The pH of the liquor is about 4.3.

The leathers are then dyed with 1.3% of a commercially available dyestuff mixture for 20 minutes and fat-liquored with about 9% of a commercially available mixture of fats comprising synthetic and natural fats for 20 minutes (pH about 4.2).

Finally, for fixing the dyestuff, 0.5% of formic acid (85% strength, diluted 1:10 with water) is added (pH about 3.4). The leathers are washed (300% of water at 20° C.) and finished by the customary procedure (set out, vacuum- and hanger-dried, conditioned, staked and vacuum-dried at 60° C. for ½ minutes).

The resulting leathers are soft, have good fullness and exhibit a pleasant fatty handle.

We claim:

1. In the retanning of leather wherein the leather is contacted with a retanning agent, the improvement which comprises employing as said retanning agent the reaction product of (A) a terpolymer having molecular weights $\overline{M}_n$, determined as number average, of 5000 to 60 000 comprised of a) maleic anhydride, b) 80 to 120 mol %, relative to component a), of diisobutylene, and c) 1 to 12 mol % relative to component a), of at least one monomer of the formula

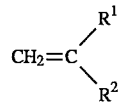

in which $R^1$ denotes hydrogen or methyl, $R^2$ denotes hydrogen, methyl, ethyl, —$OR^3$,

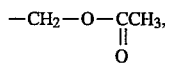

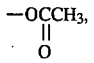

unsubstituted or $C_1$–$C_4$-alkyl substituted phenyl or hydroxymethyl, and $R^3$ denotes $C_1$–$C_4$-alkyl, (B) an aliphatic and/or cycloaliphatic monohydric $C_6$–$C_{24}$-alcohol, and (C) a base, wherein 20 to 80% of the carboxyl groups corresponding to the anhydride groups of the terpolymer are esterified with alcohol (B) and at least 20% of the remaining carboxyl groups are neutralized with base (C).

2. The method according to claim 1 wherein the monomer of component c) is selected from the group consisting of styrene, α-methylstyrene, p-methylstyrene, vinyl acetate, allyl acetate, isobutyl vinyl ether, allyl alcohol, and methyl alcohol or mixtures thereof.

3. The method according to claim 1 wherein 30 to 75% of the carboxyl groups corresponding to the anhydride groups of the terpolymer have been esterified with alcohol B.

* * * * *